US010066302B2

(12) United States Patent
Ito

(10) Patent No.: US 10,066,302 B2
(45) **Date of Patent: *Sep. 4, 2018**

(54) COMPOSITE STRUCTURAL BODY

(71) Applicant: TOTO LTD., Kitakyushu-Shi, Fukuoka (JP)

(72) Inventor: Tomokazu Ito, Fukuoka-Ken (JP)

(73) Assignee: Toto Ltd., Fukuoka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/639,343

(22) Filed: Jun. 30, 2017

(65) Prior Publication Data

US 2017/0306499 A1 Oct. 26, 2017

Related U.S. Application Data

(63) Continuation of application No. 15/189,769, filed on Jun. 22, 2016, now Pat. No. 9,738,979, which is a continuation of application No. 14/217,852, filed on Mar. 18, 2014, now Pat. No. 9,399,821.

(30) Foreign Application Priority Data

Mar. 28, 2013 (JP) ..... 2013-070326
Jan. 24, 2014 (JP) ..... 2014-011601

(51) Int. Cl.
*C23C 24/04* (2006.01)
*C23C 4/12* (2016.01)

(52) U.S. Cl.
CPC ..... *C23C 24/04* (2013.01); *C23C 4/12* (2013.01); *Y10T 428/24612* (2015.01)

(58) Field of Classification Search
CPC .... C23C 24/04; C23C 4/12; Y10T 428/24612
See application file for complete search history.

(56) References Cited

U.S. PATENT DOCUMENTS

| | | | |
|---|---|---|---|
| 5,776,588 | A | 7/1998 | Moriguchi et al. |
| 6,770,547 | B1 | 8/2004 | Inoue et al. |
| 6,822,317 | B1 | 11/2004 | Inoue et al. |
| 7,736,731 | B2 | 6/2010 | Akedo et al. |
| 2005/0245087 | A1 | 11/2005 | Sasagawa et al. |
| 2008/0145615 | A1 | 6/2008 | Jacobsen et al. |
| 2009/0304970 | A1 | 12/2009 | Imaizumi et al. |
| 2010/0285280 | A1 | 11/2010 | Yonekura et al. |
| 2012/0064237 | A1 | 3/2012 | Nitta et al. |

FOREIGN PATENT DOCUMENTS

| | | | |
|---|---|---|---|
| JP | 2005-002461 | A | 1/2005 |
| JP | 2005-310529 | A | 11/2005 |
| JP | 2007-162077 | A | 6/2007 |

*Primary Examiner* — Nathan L Van Sell
(74) *Attorney, Agent, or Firm* — Carrier Blackman & Associates, P.C.; Joseph P. Carrier; Anne G. Sabourin

(57) ABSTRACT

A composite structural body includes a base material; and a film-like structural body formed on a surface of the base material by causing an aerosol to impinge on the base material. The aerosol contains fine particles dispersed in a gas, and a distance between an end part of the film-like structural body and an outermost part closest to the end part of a portion of the film-like structural body has a film thickness equal to an average film thickness of the film-like structural body as viewed perpendicular to the surface being 10 times or more of the average film thickness.

2 Claims, 18 Drawing Sheets

| Sample | Base material | Magnification | Determination |
|---|---|---|---|
| (1) | Alumina | 7x | Peeled |
| (2) | | 9x | Peeled |
| (3) | | 10x | No peeling |
| (4) | | 20x | |
| (5) | | 58x | |
| (6) | | 100x | |
| (7) | | 1000x | |
| (8) | Quartz | 6x | Peeled |
| (9) | | 10x | No peeling |
| (10) | | 48x | |
| (11) | SUS 304 | 8x | Peeled |
| (12) | | 10x | No peeling |
| (13) | | 100x | |
| (14) | | 1000x | |

| Sample | Base material | Magnification | Determination |
|---|---|---|---|
| (15) | Alumina | 9x | Peeled |
| (16) | | 10x | No peeling |
| (17) | | 49x | |
| (18) | | 100x | |
| (19) | | 400x | |
| (20) | | 1000x | |
FIG. 10
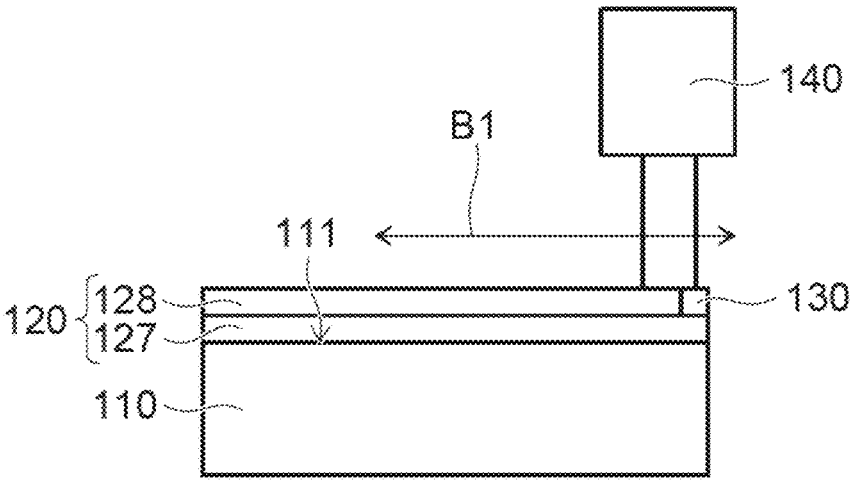
FIG. 11A
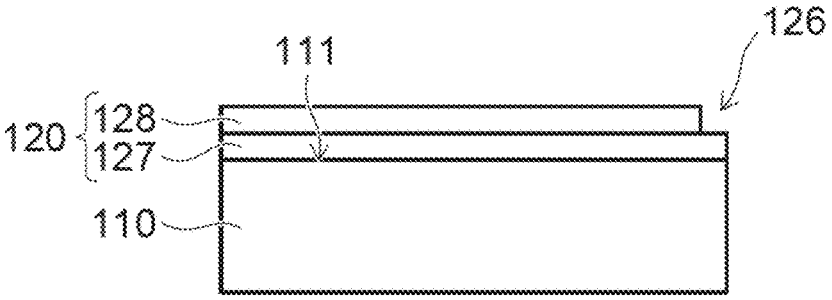
FIG. 11B

| Model | Base material | Magnification | Stress (MPa) |
|---|---|---|---|
| (1) | Quartz | 0 | 37.8 |
| (2) | | 100x | 20.5 |
| (3) | | 1000x | 7.6 |

COMPOSITE STRUCTURAL BODY

CROSS-REFERENCE TO RELATED APPLICATIONS

This application is a continuation of U.S. patent application Ser. No. 15/189,769, filed Jun. 22, 2016, which is a continuation of U.S. patent application Ser. No. 14/217,852, filed Mar. 18, 2014, which claims the benefit of priority from Japanese Patent Application No. 2013-070326, filed on Mar. 28, 2013 and Japanese Patent Application No. 2014-011601, filed on Jan. 24, 2014. The entire subject matter of each of these priority applications is incorporated herein by reference.

FIELD OF INVENTION

Embodiments of the invention relate generally to a composite structural body, and more particularly to a composite structural body in which fine particles including a brittle material such as ceramic and glass squirted from a nozzle is sprayed on a base material surface to form a structural body including the brittle material on the base material.

BACKGROUND

Methods for forming a structural body including a brittle material on the surface of a base material include e.g. the aerosol deposition method and the gas deposition method (International Patent Publication WO 01/27348, Japanese Unexamined Patent Publication No. 2007-162077, Japanese Unexamined Patent Publication No. 2005-2461). In the aerosol deposition method and the gas deposition method, fine particles including a brittle material is dispersed in a gas to form an aerosol. The aerosol is squirted from a jetting port toward the base material. Thus, the fine particles are caused to impinge on the base material such as metal, glass, ceramic, and plastic. The brittle material fine particles are deformed or fractured by the impact of this impingement, and joined. Thus, a film-like structural body including the constituent material of the fine particles is directly formed on the base material.

This method can form a film-like structural body at normal temperature without particularly requiring heating means and the like. This method can obtain a film-like structural body having a mechanical strength comparable or superior to a fired body. Furthermore, the density, mechanical strength, electrical characteristic and the like of the structural body can be variously changed by controlling e.g. the condition of impingement of fine particles, and the shape and composition of fine particles.

However, this method applies impact by repetitive impingement of fine particles to form a compact structural body. Thus, stress remains in the film-like structural body and the base material at the time of film formation. For instance, a relatively large stress is locally applied near the boundary of the film formation region and the protruding part of the base material. The problem is that in the portion subjected to a relatively large stress, the film-like structural body may be peeled by self-collapse of the film-like structural body.

Furthermore, for instance, in the case of forming a film-like structural body on a flat surface or side surface, a relatively large stress is locally applied near the boundary of the film formation region. Starting from this boundary, the film-like structural body may be peeled. Moreover, in the case where the end part of the film-like structural body is provided in the surface of the target (base material) of the formation of the film-like structural body, stress concentrates near the end part. Thus, thickening of the film thickness may cause self-collapse of the film-like structural body. Peeling and self-collapse of the film-like structural body may occur not only immediately after the formation of the film-like structural body, but also after the lapse of e.g. one day or one week, because of fatigue due to stress accumulated in the film-like structural body or the base material.

SUMMARY

According to an aspect of the invention, there is provided a composite structural body including a base material; and a film-like structural body formed on a surface of the base material by causing an aerosol to impinge on the base material, the aerosol including fine particles dispersed in a gas, a distance between an end part of the film-like structural body and an outermost part closest to the end part of a portion of the film-like structural body having a film thickness equal to an average film thickness of the film-like structural body as viewed perpendicular to the surface being 10 times or more of the average film thickness.

BRIEF DESCRIPTION OF THE DRAWINGS

FIG. 10 is a table illustrating an example of the investigation result of the presence or absence of peeling of the film-like structural body including aluminum oxide;

FIG. 11A and FIG. 11B are schematic sectional views describing the method for forming the film-like structural body in which the film thickness is changed stepwise in two or more steps;

DETAILED DESCRIPTION

Figure 1A:
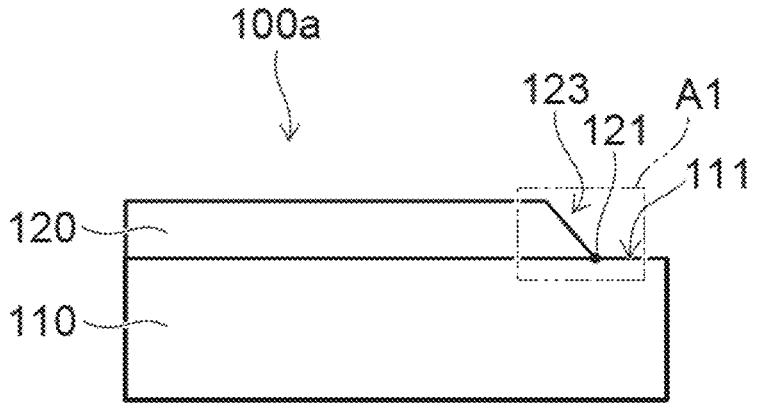
FIG. 1A and FIG. 1B are schematic sectional views showing a composite structural body according to an embodiment of the invention.

The first invention is a composite structural body including a base material; and a film-like structural body formed on a surface of the base material by causing an aerosol to impinge on the base material, the aerosol including fine particles dispersed in a gas, a distance between an end part of the film-like structural body and an outermost part closest to the end part of a portion of the film-like structural body having a film thickness equal to an average film thickness of the film-like structural body as viewed perpendicular to the surface being 10 times or more of the average film thickness.

In other words, the composite structural body includes a base material; and a film-like structural body formed on a surface of the base material by causing an aerosol to impinge on the base material, the aerosol including fine particles dispersed in a gas, and when the film-like structural body is viewed perpendicular to the surface, it has a first portion with an average film thickness, and a second portion with a film thickness that changes from the average film thickness over a length of a peripheral edge portion of the film-like structural body. The length of the peripheral edge portion is measured along a surface of the base material and is 10 times or more of the average film thickness.

In this composite structural body, the stress applied to the base material and the film-like structural body can be relaxed near the end part of the film-like structural body. This can suppress the occurrence of peeling and collapse of the film-like structural body or collapse of the base material. The distance between the end part of the film-like structural body and the outermost part closest to the end part of the portion of the film-like structural body having a film thickness equal to the average film thickness thereof as viewed perpendicular to the surface of the base material is preferably 10 times or more of the average film thickness. More preferably, the distance is 20 times or more, or 50 times or more, of the average film thickness. Still more preferably, the distance is 100 times or more of the average film thickness. Furthermore, the effect of relaxing the stress can be expected by lengthening the distance between the end part of the film-like structural body and the outermost part closest to the end part of the portion of the film-like structural body having a film thickness equal to the average film thickness thereof as viewed perpendicular to the surface of the base material. In view of design as an industrial product, the distance is preferably set to approximately 10000 times or less of the average film thickness.

The second invention is the composite structural body of the first invention, wherein the film-like structural body includes a slope part in which the film thickness is thinned stepwise from the outermost part to the end part.

In this composite structural body, the slope part of the film-like structural body can be formed relatively easily. Furthermore, the shape of the film-like structural body (e.g., the shape of the slope part) can be controlled with a desired accuracy. Thus, the stress applied to the base material and the film-like structural body can be relaxed near the end part of the film-like structural body by a relatively simple method or a method with a desired accuracy. This can suppress the occurrence of peeling and collapse of the film-like structural body or collapse of the base material.

Third invention is the composite structural body of the first invention, wherein the film-like structural body includes a slope part in which the film thickness is thinned continuously from the outermost part to the end part.

In this composite structural body, the slope part having a continuously changing film thickness can be formed by a simple mechanism such as adjusting the spraying angle of particles or smoothly polishing the film outer peripheral part. Thus, the stress applied to the base material and the film-like structural body can be relaxed near the end part of the film-like structural body by a simple mechanism. This can suppress the occurrence of peeling and collapse of the film-like structural body or collapse of the base material.

The fourth invention is the composite structural body of the first invention, wherein the base material includes a round part in which the surface is curved, the round part being provided in a region including the end part, and a radius of the round part is 10 times or more of the average film thickness.

The fifth invention is the composite structural body of the second invention, wherein the base material includes a round part in which the surface is curved, the round part being provided in a region including the end part, and a radius of the round part is 10 times or more of the average film thickness.

The sixth invention is the composite structural body of the third invention, wherein the base material includes a round part in which the surface is curved, the round part being provided in a region including the end part, and a radius of the round part is 10 times or more of the average film thickness.

In these composite structural bodies, the slope part of the film thickness is easily formed on the round part. Furthermore, the stress applied near the substrate end part can be further relaxed. Thus, the stress applied to the base material and the film-like structural body can be further relaxed. This can further suppress the occurrence of peeling and collapse of the film-like structural body or collapse of the base material.

Embodiments of the invention will now be described with reference to the drawings. In the drawings, similar components are labeled with like reference numerals, and the detailed description thereof is omitted appropriately.

Figure 1B:
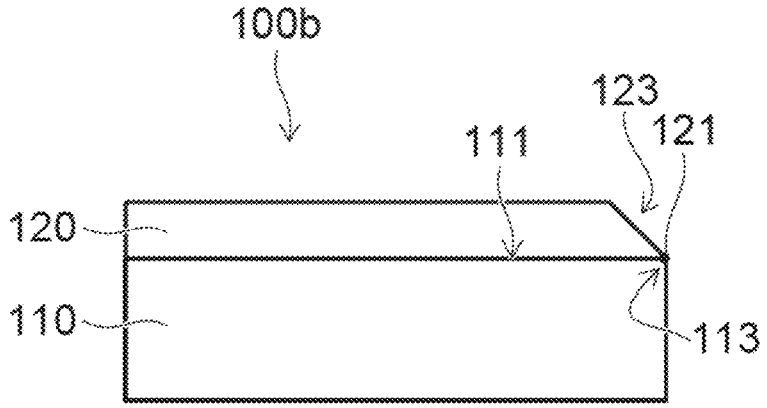

FIG. 1A and FIG. 1B are schematic sectional views showing a composite structural body according to an embodiment of the invention.

Figure 2A:
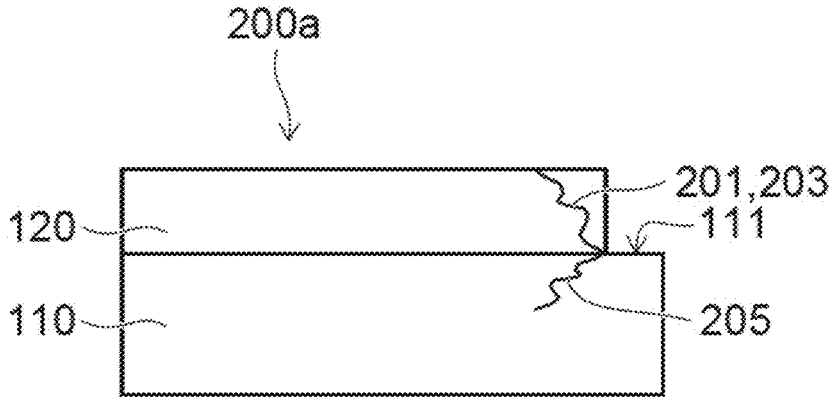
FIG. 2A and FIG. 2B are schematic sectional views showing a composite structural body according to a comparative example of this embodiment.
Figure 2B:
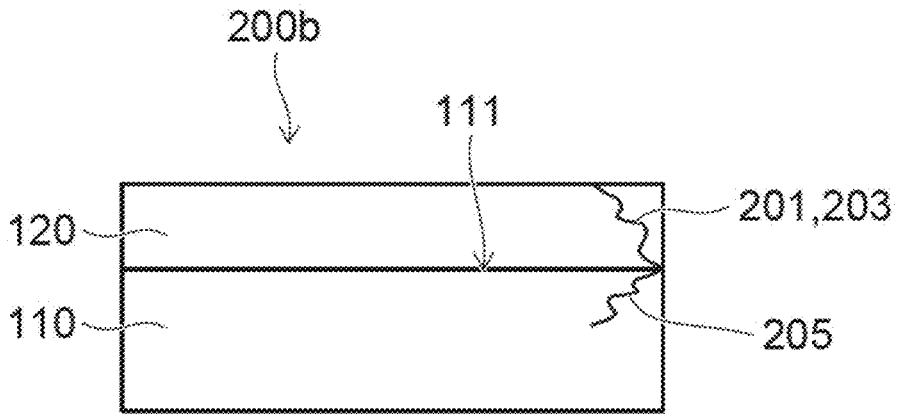

FIG. 2A and FIG. 2B are schematic sectional views showing a composite structural body according to a comparative example of this embodiment.

FIG. 1A and FIG. 2A are schematic sectional views showing composite structural bodies in which the end part of the film-like structural body is provided on the surface of the base material. FIG. 1B and FIG. 2B are schematic sectional views showing composite structural bodies in which the end part of the film-like structural body is provided on the ridge part of the base material.

The composite structural body 100*a* shown in FIG. 1A and the composite structural body 100*b* shown in FIG. 1B include a base material 110 and a film-like structural body 120 provided on the base material 110. The film-like structural body 120 is formed by e.g. the aerosol deposition method or the gas deposition method. In these methods, fine particles including a brittle material are dispersed in a gas to form an aerosol. The aerosol is squirted from a jetting port such as a nozzle toward the base material 110.

In the composite structural body 100*a* shown in FIG. 1A, the end part 121 of the film-like structural body 120 is located on the surface 111 of the base material 110. In other words, the end part 121 of the film-like structural body 120 in the composite structural body 100*a* shown in FIG. 1A is located halfway through the surface 111 inside the ridge part 113 (see FIG. 1B) of the base material 110.

On the other hand, in the composite structural body 100*b* shown in FIG. 1B, the end part 121 of the film-like structural body 120 is located on the ridge part 113 of the base material 110. In other words, the end part 121 of the film-like structural body 120 in the composite structural body 100*b* shown in FIG. 1B extends on the ridge part 113 of the base material 110.

In the following, this embodiment is described with reference to an example in which the film-like structural body 120 is formed by the aerosol deposition method.

Before describing the principle of the aerosol deposition method, terms used herein are first described.

The term "fine particle" used herein refers, in the case of a compact particle, to a particle such that the average particle diameter identified by e.g. a scanning electron microscope is 0.1 micrometers or more and 10 micrometers or less. The "primary particle" refers to the minimum unit (single grain) of a fine particle. In the identification of the average particle diameter by a scanning electron microscope, 100 fine particles are arbitrarily selected in the observed image. Using the average value of the long axis and the short axis, the average particle diameter can be calculated from the average values of all the observed fine particles. The brittle material particles in the fine particles primarily compose a structural body in the aerosol deposition method. The average particle diameter of the primary particle is 0.01 micrometers or more and 10 micrometers or less, and more preferably 0.1 micrometers or more and 5 micrometers or less.

The term "aerosol" used herein refers to the state of the aforementioned fine particles dispersed in a gas such as helium gas, argon gas or other inert gases, nitrogen gas, oxygen gas, dry air, hydrogen gas, organic gas, fluorine gas, and a mixed gas including them. The aerosol may partly include aggregates. However, the "aerosol" refers to the state of fine particles dispersed substantially independently. The gas pressure and temperature of the aerosol are arbitrary. However, the concentration of fine particles in the gas preferable for the formation of the film-like structural body is in the range of 0.0003-10 mL/L under the condition of a gas pressure of 1 atm and a temperature of 20 degrees Celsius at the time of being squirted from the jetting port such as a nozzle.

Next, the principle of the aerosol deposition method is described.

The fine particles used in the aerosol deposition method are primarily composed of a brittle material such as ceramic and semiconductor. Fine particles of the same material may be used alone, or a mixture of fine particles having different particle diameters may be used. Alternatively, a mixture or composite of different kinds of brittle material fine particles can be used. Furthermore, fine particles of a metal material, organic material or the like may be mixed with brittle material fine particles, or used as a coating on the surface of brittle material fine particles. However, also in these cases, the film-like structural body is primarily formed from the brittle material.

In the aerosol deposition method, fine particles are caused to impinge on the base material at a speed of 50-450 m/s. This is preferable in obtaining a structural body including the constituent material of the brittle material fine particles in the fine particles.

Normally, the process of the aerosol deposition method is performed at normal temperature. A film-like structural body can be formed at a temperature sufficiently lower than the melting point of the fine particle material, i.e., below several hundred degrees Celsius. This is one of the features of the aerosol deposition method.

In the case where crystalline brittle material fine particles are used as a raw material, the crystal particle size is smaller than the raw material fine particle size in the portion of the film-like structural body in the composite structural body formed by the aerosol deposition method. The portion of the film-like structural body is a polycrystal. In most cases, the crystal substantially lacks crystal orientation. Furthermore, at the interface between the brittle material crystals, the grain boundary layer made of a glass layer does not substantially exist. Furthermore, in most cases, an "anchor layer" biting into the surface of the base material is formed in the portion of the film-like structural body. Because the anchor layer is formed, the formed film-like structural body is robustly attached to the base material with extremely high strength.

The film-like structural body formed by the aerosol deposition method has sufficient strength, clearly different from what is called "compacted powder". In compacted powder, fine particles are packed by pressure and keep the shape by physical attachment. A high-quality film-like structural body formed by the aerosol deposition method has hardness comparable to that of a bulk formed by the firing method using the material thereof.

In this case, in the aerosol deposition method, the incoming brittle material fine particle is fractured or deformed on the base material. This can be verified by using X-ray diffractometry and the like to measure the crystallite size of the brittle material fine particle used as a raw material and the crystallite size of the formed brittle material structural body.

The crystallite size of the film-like structural body formed by the aerosol deposition method is smaller than the crystallite size of the raw material fine particle. Furthermore, a "shear surface" or "fracture surface" is formed as a "fresh surface" by fracturing or deformation of the fine particle. In the fresh surface, atoms originally located inside the fine particle and coupled to other atoms are exposed. The fresh surface is active with high surface energy. It is considered that the fresh surface is joined with the surface of the adjacent brittle material fine particle, a fresh surface of the adjacent brittle material, or the surface of the base material to form a film-like structural body.

In the case where hydroxy groups moderately exist at the surface of fine particles in the aerosol, a mechanochemical acid-base dehydration reaction occurs by local shear stress and the like generated between the fine particles or between the fine particle and the structural body at the time of impingement of the fine particles. It is considered that this causes junction therebetween. External application of continuous mechanical impact continually causes there phenomena. Thus, the junction is advanced and compacted by the repetition of deformation, fracturing and the like of the fine particles. It is considered that this causes growth of the film-like structural body made of the brittle material.

Here, in the process in which the film-like structural body 120 is formed by the aerosol deposition method, stress is applied to at least one of the base material 110 and the film-like structural body 120 by external application of continuous mechanical impact. Furthermore, the strain increases with the growth of the film-like structural body 120. In the case where the base material 110 is made of a ductile material such as stainless steel and aluminum, the base material 110 may be deformed by the stress. Alternatively, in the case where the base material 110 is made of a brittle material such as glass and silicon wafer, the base material 110 may be chipped or depressed.

In general, stress tends to concentrate on a portion having a locally pointed shape and an end part of the formed film-like structural body 120. In a composite structural body 200*a* shown in FIG. 2A and a composite structural body 200*b* shown in FIG. 2B, the angle of the end part of the film-like structural body 120 with respect to the surface 111 of the base material 110 is relatively large in the cross-sectional view of the composite structural body 200*a*, 200*b* as viewed from the lateral side. In this case, peeling 201 and collapse 203 of the film-like structural body 120 or collapse 205 of the base material 110 may occur starting from the site where the stress locally concentrates.

In contrast, in the composite structural body 100*a*, 100*b* according to this embodiment, a slope part 123 is provided in the end part of the film-like structural body 120. As shown in FIGS. 1A and 1B, the film thickness of the film-like structural body 120 in the slope part 123 is thinned generally continuously from the inside toward the end part of the film-like structural body 120. The upper part of the slope part 123 is set back further to the inside of the film-like structural body 120 than the lower part (contact part with the base material 110) of the slope part 123. This is further described with reference to the drawings.

Figure 3:
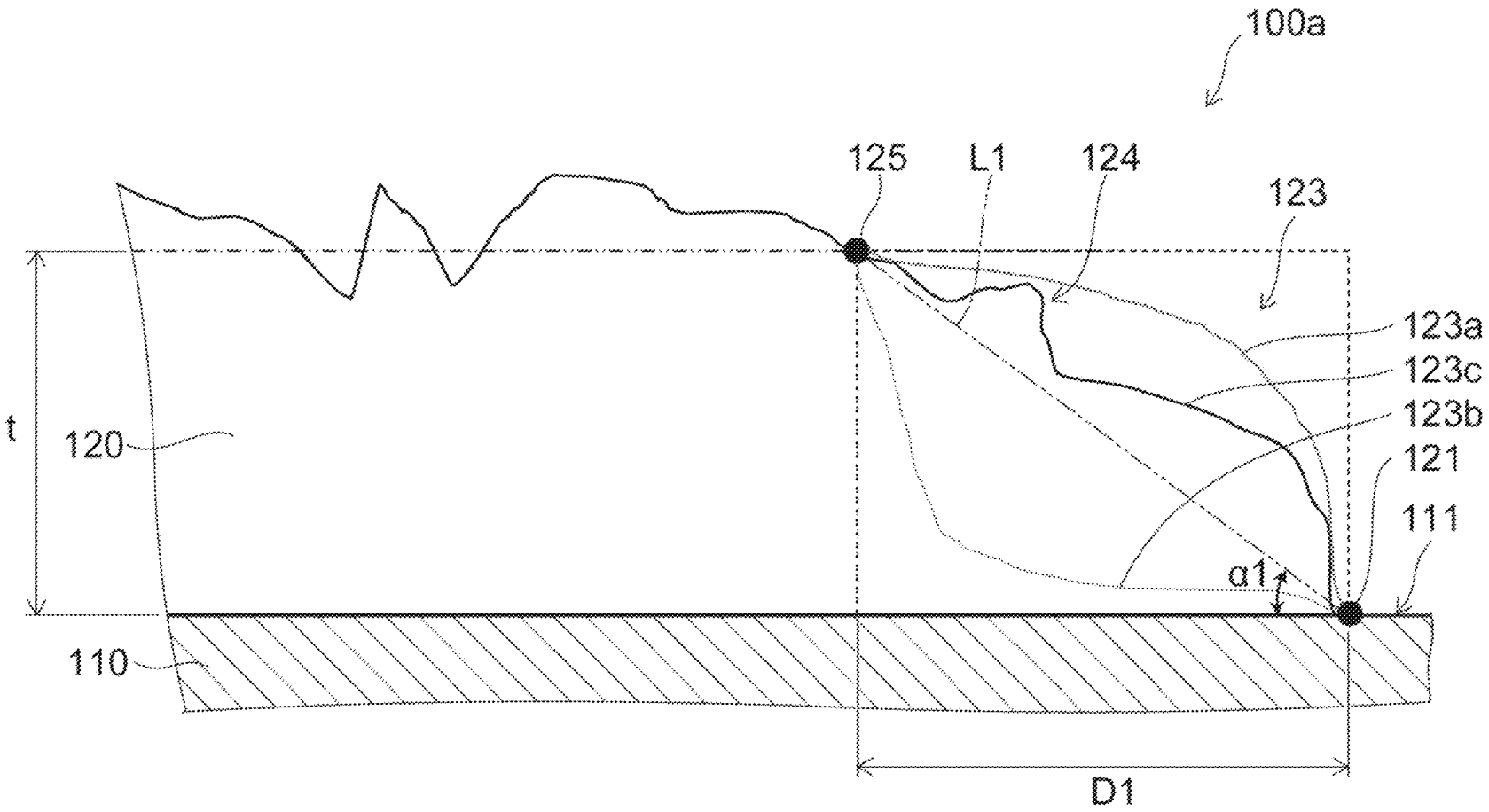
FIG. 3 is a schematic sectional view enlarging the region A1 shown in FIG. 1A.

FIG. 3 is a schematic sectional view enlarging the region A1 shown in FIG. 1A.

As shown in FIG. 3, in the enlarged view near the end part of the film-like structural body 120, the surface (upper surface) of the film-like structural body 120 is not flat, but has an uneven shape. Furthermore, there is a portion in which the film thickness of the film-like structural body 120 is equal to the average film thickness t. In this embodiment, the outermost part 125 is defined as the outermost point (the point closest to the end part 121) of the portion in which the film thickness of the film-like structural body 120 is equal to the average film thickness t.

Here, the term "average film thickness" used herein refers to the average value of the thickness of the film-like structural body 120 joined to the base material 110. In the case where there are variations in the thickness of the film-like structural body 120, the "average film thickness" is determined as the average of a plurality of measurements. For instance, the thickness of a set of film-like structural bodies 120 is measured at a necessary and sufficient number of points, and the "average film thickness" is determined as the average value of the measured values. Specifically, the "average film thickness" is determined as the average value of the values measured at 100 points equally spaced between the end parts on the longest line of the shape of the film-like structural body 120 except the end parts where the film thickness is zero. For instance, the shape of the film-like structural body 120 may be a quadrangle as viewed perpendicular to the surface 111 of the base material 110. In this case, the "average film thickness" is determined as the average value of the values measured at 100 points equally spaced between the end parts on the diagonal of the quadrangle except the end parts where the film thickness is zero. Alternatively, the shape of the film-like structural body 120 may include a circular arc as viewed perpendicular to the surface 111 of the base material 110. In this case, the "average film thickness" is determined as the average value of the values measured at 100 points equally spaced between the end parts on the base material including the circular arc except the end parts where the film thickness is zero.

The thickness of the film-like structural body 120 can be determined from the step difference between the base material 110 and the surface of the film-like structural body 120, or the thickness of the film-like structural body 120 verified in the cross-sectional image. Alternatively, the thickness of the film-like structural body 120 can be determined by e.g. a film thickness meter of what is called the transparent type based on ultraviolet radiation, visible light, infrared radiation, X-ray, β-ray or the like, a film thickness meter based on electrostatic capacitance and eddy current, a film thickness meter based on electrostatic capacitance and electrical resistance, or an electromagnetic film thickness meter based on magnetic force.

In the case where the specific weight of the film-like structural body 120 is known and the cross-sectional information of the film-like structural body 120 is difficult to calculate, the average film thickness can be calculated from the weight of the film-like structural body 120. More specifically, the volume of the film-like structural body 120 is calculated from the weight of the film-like structural body 120 and the specific weight of the film-like structural body 120, and divided by the area of the film-like structural body 120 as viewed perpendicular to the surface 111 of the base material 110. Thus, the average film thickness can be calculated.

As described above with reference to FIG. 1A and FIG. 1B, the film-like structural body 120 includes a slope part 123 provided in the end part. The film thickness of the film-like structural body 120 in the slope part 123 is changed as viewed from the outermost part 125 to the end part 121 generally along the surface 111 of the base material 110.

For instance, in the first slope surface 123*a* and the second slope surface 123*b* shown in FIG. 3, the film thickness of the film-like structural body 120 is thinned generally continuously from the outermost part 125 toward the end part 121. The slope angle of the first slope surface 123*a* in the outermost part 125 is smaller than the slope angle of the first slope surface 123*a* in the end part 121. In other words, the first slope surface 123*a* in the outermost part 125 is a more "gradual slope" than the first slope surface 123*a* in the end part 121. On the other hand, the slope angle of the second slope surface 123*b* in the outermost part 125 is larger than the slope angle of the second slope surface 123*b* in the end part 121. In other words, the second slope surface 123*b* in the outermost part 125 is a "steeper slope" than the second slope surface 123*b* in the end part 121.

On the other hand, for instance, in the third slope surface 123*c* shown in FIG. 3, the film thickness of the film-like structural body 120 is thinned generally stepwise from the outermost part 125 toward the end part 121. That is, as shown in FIG. 3, the third slope surface 123*c* includes a step-like part 124 between the outermost part 125 and the end part 121. This will be described later in detail.

In the composite structural body 100*a* according to this embodiment, in any of the first to third slope surfaces 123*a*-123*c*, the distance D1 between the outermost part 125 and the end part 121 as viewed perpendicular to the surface 111 is 10 times or more of the average film thickness t.

The method for measuring the distance D1 between the outermost part 125 and the end part 121 as viewed perpendicular to the surface 111 can be a method using a surface shape measuring instrument. For instance, the shape of the surface of the film-like structural body 120 and the surface 111 of the base material 110 is measured using the surface shape measuring instrument to determine the outermost part 125 and the end part 121. Subsequently, the distance D1 can be determined by measuring the distance between the portion obtained by projecting the outermost part 125 perpendicularly on the surface 111 of the base material 110 and the portion obtained by projecting the end part 121 perpendicularly on the surface 111 of the base material 110.

Alternatively, the method for measuring the distance D1 can be a method using a cross-sectional photograph (such as SEM). For instance, a cross-sectional photograph of the composite structural body (e.g., composite structural body 100*a*) is taken. The outermost part 125 and the end part 121 are determined on the cross-sectional photograph. Subsequently, the distance D1 can be determined by measuring the distance between the portion obtained by projecting the outermost part 125 perpendicularly on the surface 111 of the base material 110 and the portion obtained by projecting the end part 121 perpendicularly on the surface 111 of the base material 110.

Alternatively, the method for measuring the distance D1 can be a method using a film thickness meter. For instance, the film thickness meter used to measure the film thickness of the film-like structural body 120 is used to measure the slope part 123 on a straight line at spacings comparable to e.g. the average film thickness t. Subsequently, the distance D1 can be determined from the coordinates on the straight line measured by the film thickness meter.

The distances D2-D6 described later can also be measured by similar methods.

Thus, the stress applied to the base material 110 and the film-like structural body 120 can be relaxed in the end part of the film-like structural body 120. This can suppress the occurrence of peeling 201 and collapse 203 of the film-like structural body 120 or collapse 205 of the base material 110.

The structure of the composite structural body 100*b* described above with reference to FIG. 1B in the end part of the film-like structural body 120 is similar to the structure of the aforementioned composite structural body 100*a* in the end part of the film-like structural body 120. Thus, an effect similar to the effect of the aforementioned composite structural body 100*a* is achieved also in the composite structural body 100*b* described above with reference to FIG. 1B.

The slope part 123 of the film-like structural body 120 is a portion in which the film thickness of the film-like structural body 120 is changed. That is, the slope of the film-like structural body 120 means that the film thickness of the film-like structural body 120 is changed. The slope part 123 of the film-like structural body 120 may be formed by providing a slope in the shape of the film-like structural body 120, or by previously changing the shape (e.g., thickness) of the base material 110. This is further described.

Figure 4A:
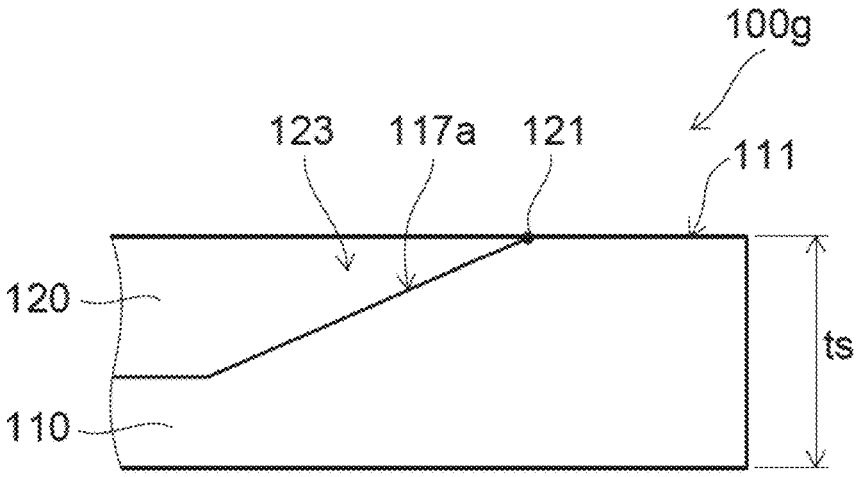
FIG. 4A to FIG. 4C are schematic sectional views describing slope parts of the film-like structural body of this embodiment.
Figure 4B:
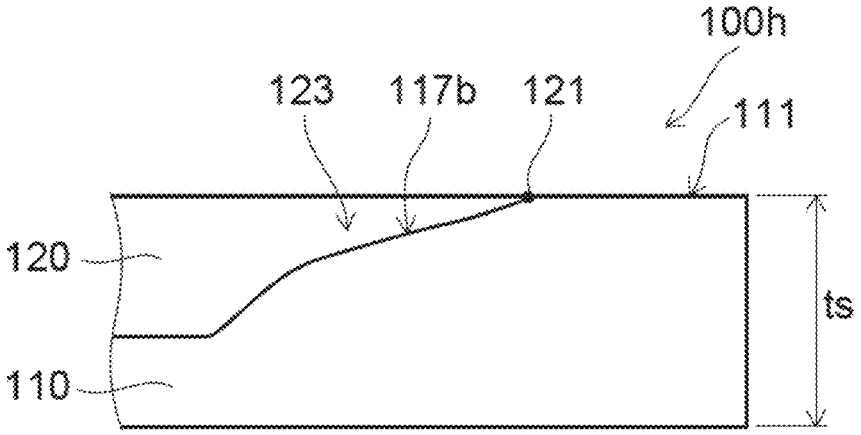
Figure 4C:
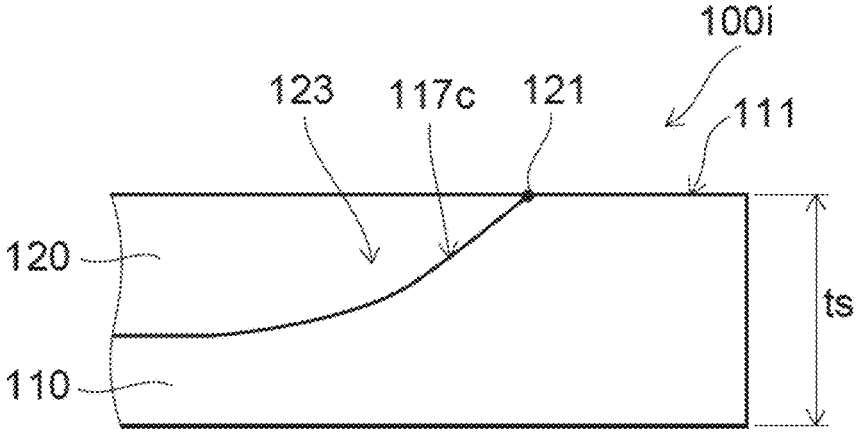

FIG. 4A to FIG. 4C are schematic sectional views describing slope parts of the film-like structural body of this embodiment.

FIG. 4A is a schematic sectional view describing a slope part of the film-like structural body of this embodiment. FIG. 4B is a schematic sectional view describing an alternative slope part of the film-like structural body of this embodiment. FIG. 4C is a schematic sectional view describing a further alternative slope part of the film-like structural body of this embodiment.

As described above, the slope of the film-like structural body 120 means that the film thickness of the film-like structural body 120 is changed. Thus, as shown in FIG. 4A to FIG. 4C, the slope part 123 of the film-like structural body 120 may be formed by previously changing the shape (e.g., thickness) of the base material 110.

In the composite structural body 100*g* shown in FIG. 4A, the thickness ts of the base material 110 in the slope part 123 of the film-like structural body 120 is thickened generally linearly from the central part toward the end part 121 of the film-like structural body 120. That is, the slope angle of the first slope surface 117*a* of the base material 110 is generally constant from the central part toward the end part 121 of the film-like structural body 120.

In the composite structural body 100*h* shown in FIG. 4B and the composite structural body 100*i* shown in FIG. 4C, the thickness ts of the base material 110 in the slope part 123 of the film-like structural body 120 is thickened generally continuously from the central part toward the end part 121 of the film-like structural body 120. As shown in FIG. 4B, the slope angle of the second slope surface 117*b* on the relatively central part side of the film-like structural body 120 is larger than the slope angle of the second slope surface 117*b* on the relatively end part 121 side of the film-like structural body 120. As shown in FIG. 4C, the slope angle of the third slope surface 117*c* on the relatively central part side of the film-like structural body 120 is smaller than the slope angle of the third slope surface 117*c* on the relatively end part 121 side of the film-like structural body 120.

A compact structural body is formed in any slope part 123 shown in FIG. 1A, FIG. 1B, FIG. 3, FIG. 4A, FIG. 4B, and FIG. 4C. Whether the slope part 123 includes a compact structural body can be determined by measuring the hardness of the slope part 123. According to this embodiment, even in the case where a compact structural body is formed near the end part 121 of the film-like structural body 120, a slope part 123 is provided near the end part 121 of the film-like structural body 120. This can suppress the occurrence of peeling 201 and collapse 203 of the film-like structural body 120 or collapse 205 of the base material 110. Depending on the purpose of the composite structural body 100*g*, functionality may be required also near the end part 121 of the film-like structural body 120. Even in this case, because a slope part 123 is provided near the end part 121 of the film-like structural body 120, the film quality of the film-like structural body 120 is kept constant. Thus, functionality can be fulfilled also near the end part 121 of the film-like structural body 120. Details on whether the slope part 123 includes a compact structural body will be described later.

Figure 5A:
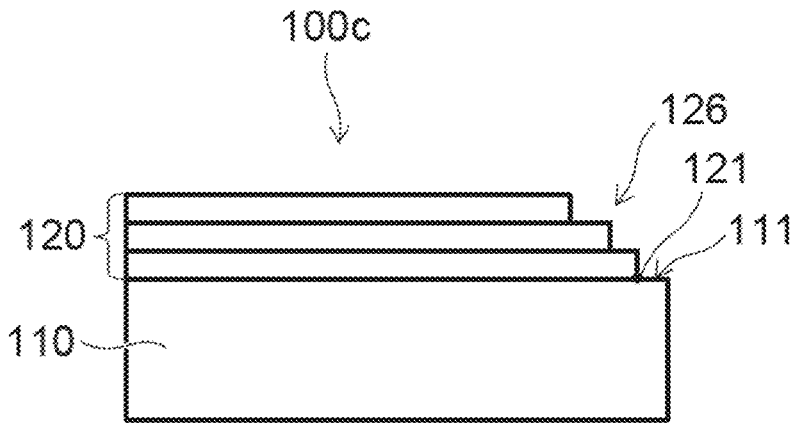
FIG. 5A and FIG. 5B are schematic sectional views showing a composite structural body according to an alternative embodiment of the invention.
Figure 5B:
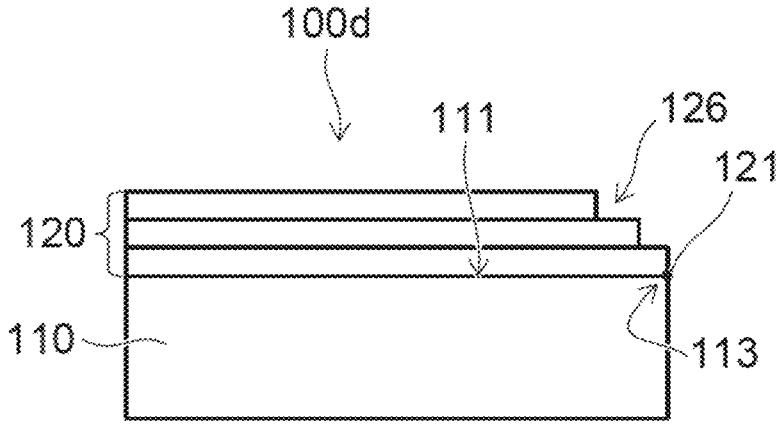

FIG. 5A and FIG. 5B are schematic sectional views showing a composite structural body according to an alternative embodiment of the invention.

FIG. 5A is a schematic sectional view showing a composite structural body in which the end part of the film-like structural body is provided on the surface of the base material. FIG. 5B is a schematic sectional view showing a composite structural body in which the end part of the film-like structural body is provided on the ridge part of the base material.

The composite structural body 100*c* shown in FIG. 5A and the composite structural body 100*d* shown in FIG. 5B include a base material 110 and a film-like structural body 120 provided on the base material 110. The film-like structural body 120 is formed by the aerosol deposition method or the like described above with reference to FIG. 1A and FIG. 1B.

In the composite structural body 100*c*, 100*d* according to this embodiment, a slope part 126 is provided in the end part of the film-like structural body 120. As shown in FIG. 5A and FIG. 5B, the film thickness of the film-like structural body 120 in the slope part 126 is thinned generally stepwise from the inside toward the end part of the film-like structural body 120. That is, the film thickness of the film-like structural body 120 is thinned stepwise from the outermost part 125 (see FIG. 3) toward the end part 121 (see FIG. 3). The rest of the structure of the composite structural body 100*c* is similar to the structure of the composite structural body 100*a* described above with reference to FIG. 1A. The rest of the structure of the composite structural body 100*d* is similar to the structure of the composite structural body 100*b* described above with reference to FIG. 1B.

According to this embodiment, the slope part 126 of the film-like structural body 120 can be formed relatively easily. Thus, the stress applied to the base material 110 and the film-like structural body 120 can be relaxed in the end part of the film-like structural body 120 by a relatively simple method. This can suppress the occurrence of peeling 201 and collapse 203 of the film-like structural body 120 or collapse 205 of the base material 110. The method for forming the slope part 126 of this embodiment will be described later in detail.

Figure 6A:
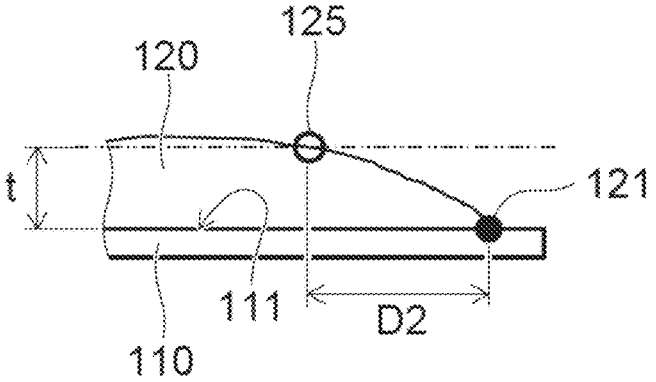
FIG. 6A to FIG. 6C are schematic sectional views illustrating alternative shapes of the slope part of this embodiment.
Figure 6B:
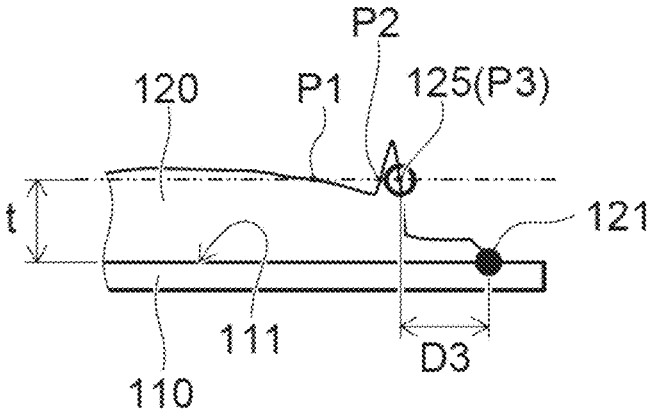
Figure 6C:
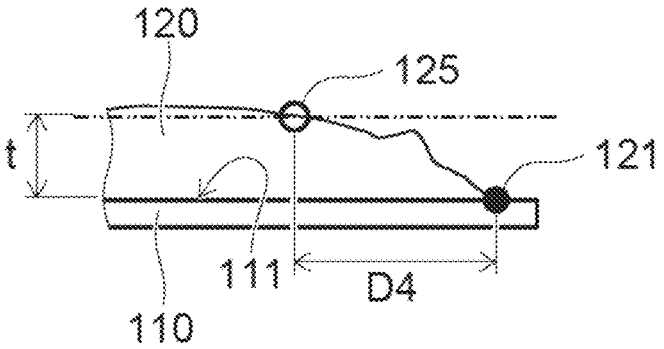

FIG. 6A to FIG. 6C are schematic sectional views illustrating alternative shapes of the slope part of this embodiment.

FIG. 6A is a schematic sectional view illustrating an example in which the film thickness of the film-like structural body in the slope part is continuously changed. FIG. 6B is a schematic sectional view illustrating an example in which the film thickness of the film-like structural body in the slope part is locally thickened. FIG. 6C is a schematic sectional view illustrating an example in which the film thickness of the film-like structural body in the slope part is thickened in a part.

In FIG. 6A, the film thickness of the film-like structural body 120 is thinned generally continuously from the inside toward the end part of the film-like structural body 120. In this case, there is one point near the end part 121 where the film thickness of the film-like structural body 120 is equal to the average film thickness t. The point is the outermost part 125. The distance D2 between the outermost part 125 and the end part 121 as viewed perpendicular to the surface 111 is 10 times or more of the average film thickness t.

In FIG. 6B, as viewed from the inside toward the end part of the film-like structural body 120, the film thickness of the film-like structural body 120 is once made thinner than the average film thickness t, then locally made thicker than the average film thickness t, and again made thinner than the average film thickness t. In this case, there are three points (point P1, point P2, and point P3) near the end part 121 where the film thickness of the film-like structural body 120 is equal to the average film thickness t. The point P3 located outermost of the points P1-P3 is the outermost part 125. The distance D3 between the outermost part 125 and the end part 121 as viewed perpendicular to the surface 111 is 10 times or more of the average film thickness t. The film thickness of the film-like structural body 120 is thinned generally stepwise from the outermost part 125 toward the end part 121.

In FIG. 6C, as viewed from the inside toward the end part of the film-like structural body 120, the film thickness of the film-like structural body 120 is once made thinner than the average film thickness t, and then thickened in a part, but remains thinner than the average film thickness t. In this case, there is one point near the end part 121 where the film thickness of the film-like structural body 120 is equal to the average film thickness t. The point is the outermost part 125. The distance D4 between the outermost part 125 and the end part 121 as viewed perpendicular to the surface 111 is 10 times or more of the average film thickness t.

Thus, the slope part 123 of this embodiment can assume various shapes. Whichever shape the slope part of the film-like structural body 120 may have, the slope part is encompassed within the scope of the slope part 123 of this embodiment as long as the distance between the outermost part 125 and the end part 121 as viewed perpendicular to the surface 111 is 10 times or more of the average film thickness t.

Figure 7A:
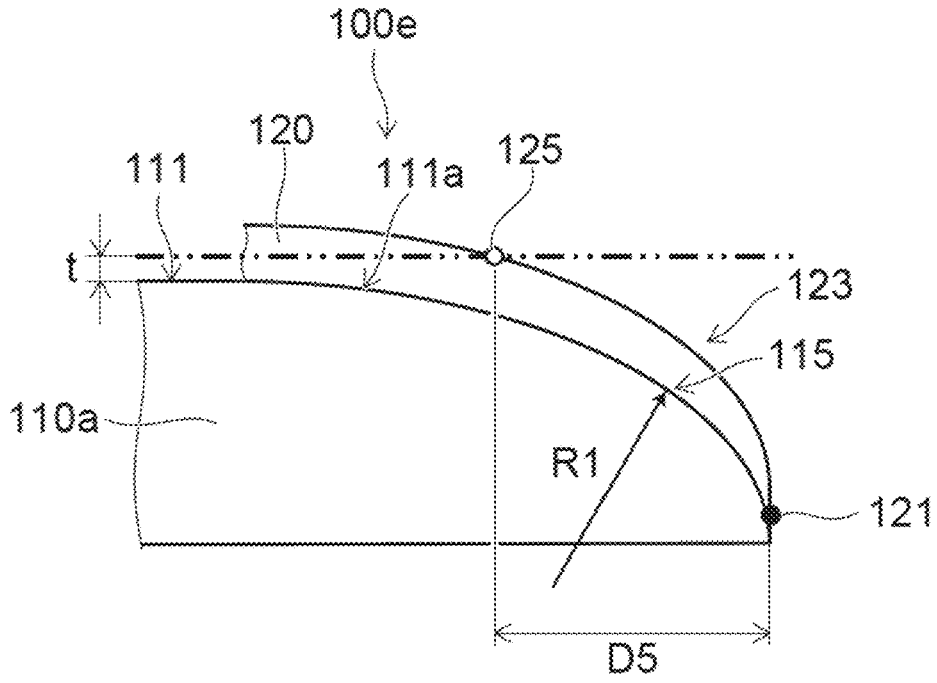
FIG. 7A and FIG. 7B are schematic sectional views illustrating alternative shapes near the end part of this embodiment.
Figure 7B:
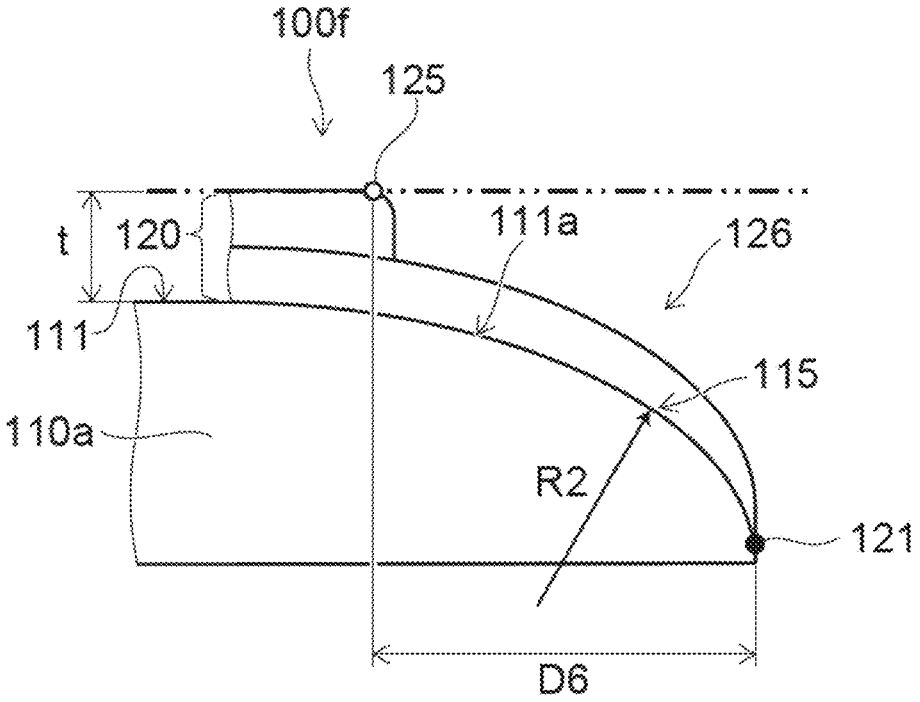

FIG. 7A and FIG. 7B are schematic sectional views illustrating alternative shapes near the end part of this embodiment.

Figures 8, 9:
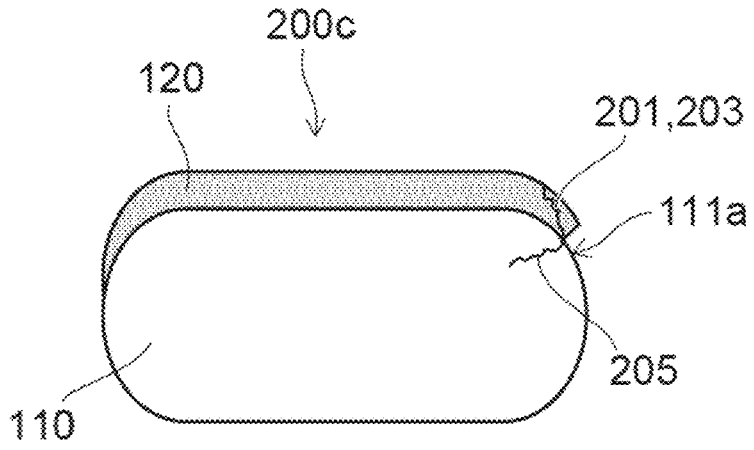
FIG. 8 is a schematic sectional view illustrating the shape of the end part of a comparative example.
FIG. 9 is a table illustrating an example of the investigation result of the presence or absence of peeling of the film-like structural body including yttrium oxide.

FIG. 8 is a schematic sectional view illustrating the shape of the end part of a comparative example.

FIG. 7A illustrates the case where the film thickness of the film-like structural body 120 in the slope part 123 is thinned generally continuously from the inside toward the end part of the film-like structural body 120. FIG. 7B illustrates the case where the film thickness of the film-like structural body 120 in the slope part 126 is thinned generally stepwise from the inside toward the end part of the film-like structural body 120.

In the composite structural body 100*b* described above with reference to FIG. 1B, the end part 121 of the film-like structural body 120 extends on the ridge part 113 of the base material 110. In contrast, in the composite structural body 100*e* shown in FIG. 7A, the base material 110*a* includes a round part 115 in the region including the end part 121 of the film-like structural body 120. As shown in FIG. 7A, the round part 115 has a curved surface 111*a*. The curved surface 111*a* has a shape in which the surface of the base material 110*a* is curved. Thus, the base material 110*a* of the composite structural body 100*e* does not include the ridge part 113. Accordingly, the end part 121 of the film-like structural body 120 shown in FIG. 7A does not extend on the ridge part of the base material 110*a*. The radius R1 of the round part 115 is 10 times or more of the average film thickness t. The distance D5 between the outermost part 125 and the end part 121 as viewed perpendicular to the surface 111 is 10 times or more of the average film thickness t.

In the composite structural body 100*d* described above with reference to FIG. 5B, the end part 121 of the film-like structural body 120 extends on the ridge part 113 of the base material 110. In contrast, in the composite structural body 100*f* shown in FIG. 7B, the base material 110*a* includes a round part 115 in the region including the end part 121 of the film-like structural body 120. As shown in FIG. 7B, the round part 115 has a curved surface 111*a*. The curved surface

111*a* has a shape in which the surface of the base material 110*a* is curved. Thus, the base material 110*a* of the composite structural body 100*f* does not include the ridge part 113. Accordingly, the end part 121 of the film-like structural body 120 shown in FIG. 7B does not extend on the ridge part of the base material 110*a*. The radius R2 of the round part 115 is 10 times or more of the average film thickness t. The distance D6 between the outermost part 125 and the end part 121 as viewed perpendicular to the surface 111 is 10 times or more of the average film thickness t.

This can further relax the stress applied near the end part of the base material 110. Thus, the stress applied to the base material 110 and the film-like structural body 120 can be further relaxed. This can further suppress the occurrence of peeling 201 and collapse 203 of the film-like structural body 120 or collapse 205 of the base material 110.

In this embodiment, the radius R1 of the round part 115 is 10 times or more of the average film thickness t. The radius R2 of the round part 115 is 10 times or more of the average film thickness t. This can suppress the occurrence of peeling 201 and collapse 203 of the film-like structural body 120 or collapse 205 of the base material 110. That is, according to this embodiment, the slope part 123 of the film-like structural body 120 can be formed by using the round part 115 having a radius of 10 times or more of the average film thickness t. More preferably, the radius of the round part 115 is 100 times or more of the average film thickness t.

In FIG. 8, the terminal part of the film-like structural body 120 is provided halfway through the curved surface 111*a* of the base material 110. In this case, it may be impossible to effectively form a slope part in the terminal part simply by forming a film on the base material 110 having the curved surface 111*a*. Thus, as shown in FIG. 8, peeling 201 and collapse 203 of the film-like structural body 120 or collapse 205 of the base material 110 may occur.

In such cases, in this embodiment, the slope part 123 can be formed even in the case where the base material 110 does not have a curvature in the end part 121 of the film-like structural body 120 as in e.g. the composite structural body 100*a* shown in FIG. 1A. Thus, this embodiment can suppress collapse of the film-like structural body 120 by appropriately selecting the means for intentionally controlling the film thickness of the film-like structural body 120.

Next, investigations performed by the inventor are described with reference to the drawings.

FIG. 9 is a table illustrating an example of the investigation result of the presence or absence of peeling of the film-like structural body including yttrium oxide.

The inventor used aluminum oxide (alumina), quartz, and stainless steel (SUS 304) as the base material 110 to form a film-like structural body 120 of yttrium oxide on each base material 110 by the aerosol deposition method.

Specifically, a film-like structural body 120 of yttrium oxide was formed by using a nozzle having an opening with a prescribed opening area to appropriately set the flow rate of nitrogen gas. The pressure in the chamber was also appropriately set. The film thickness of the film-like structural body 120, and the distance between the outermost part 125 and the end part 121 as viewed perpendicular to the surface 111, were measured by surface shape measuring instrument SURFCOM 130A.

The base material 110, the magnification, and the determination result of peeling are as shown in FIG. 9.

The "magnification" in the table shown in FIG. 9 refers to the magnification ratio of the distance between the outermost part 125 and the end part 121 as viewed perpendicular to the surface 111 versus the average film thickness t. That is, the "magnification" refers to D1/*t* in the composite structural body 100*a* described above with reference to FIG. 3.

According to the table shown in FIG. 9, it has turned out that peeling of the film-like structural body 120 does not occur as long as the magnification is 10 times or more. The inventor confirmed that peeling of the film-like structural body 120 does not occur also in the case where the magnification is 30, 40, 60, 70, 80, 150, 200, 300, and 500 times. The effect of relaxing the stress can be expected by increasing the magnification. On the other hand, in view of design as an industrial product, the magnification is preferably set to approximately 10000 times or less.

The method for forming the film-like structural body 120 of samples (1) to (14) will be described later in detail.

FIG. 10 is a table illustrating an example of the investigation result of the presence or absence of peeling of the film-like structural body including aluminum oxide.

The inventor used alumina as the base material 110 to form a film-like structural body 120 of aluminum oxide on the base material 110 of alumina by the aerosol deposition method. The film formation condition of the film-like structural body 120 of aluminum oxide is similar to the condition described above with reference to FIG. 9. The distance between the opening of the nozzle and the surface 111 of the base material 110, and the pressure in the chamber, were also appropriately set. Surface shape measuring instrument SURFCOM 130A described above with reference to FIG. 9 was used as the measuring instrument.

The magnification and the determination result of peeling are as shown in FIG. 10.

That is, it has turned out that peeling of the film-like structural body 120 does not occur as long as the magnification is 10 times or more.

The method for forming the film-like structural body 120 of samples (15) to (20) will be described later in detail.

Next, specific examples of the method for forming the film-like structural body 120 of samples (1) to (20) described above with reference to FIGS. 9 and 10 are described with reference to the drawings.

FIG. 11A and FIG. 11B are schematic sectional views describing the method for forming the film-like structural body in which the film thickness is changed stepwise in two or more steps.

The film-like structural body 120 of the sample (5) shown in FIG. 9 is formed by the formation method of this specific example.

As shown in FIG. 11A, a first film body 127 is first formed by squirting an aerosol from the jetting port of the nozzle 140 toward the surface 111 of the base material 110. At this time, the first film body 127 is formed generally entirely on the surface 111 of the base material 110 by scanning the nozzle 140 or the base material 110 as indicated by arrow B1 shown in FIG. 11A.

Subsequently, as shown in FIG. 11A, a masking tape 130 is placed on the end part of the upper surface of the first film body 127. Subsequently, a second film body 128 is formed generally entirely on the surface (upper surface) of the first film body 127 except the portion of the masking tape 130 by scanning the nozzle 140 or the base material 110 as indicated by arrow B1 shown in FIG. 11A.

Subsequently, as shown in FIG. 11B, the masking tape 130 is removed. Thus, a film-like structural body 120 can be formed in which the film thickness is changed stepwise in two or more steps from the inside toward the end part of the film-like structural body 120. That is, a slope part 126 can be formed in the end part of the film-like structural body 120.

The formation method of this specific example can control the shape of the film-like structural body 120 (e.g., the shape of the slope part 126) with a desired accuracy.

Figure 12A:
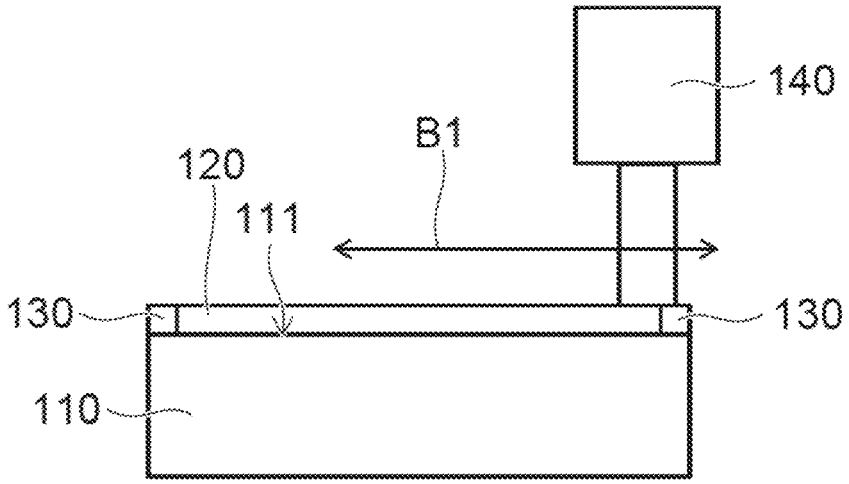
FIG. 12A and FIG. 12B are schematic sectional views describing the method for forming the film-like structural body in which the film thickness is changed stepwise in one step.
Figure 12B:
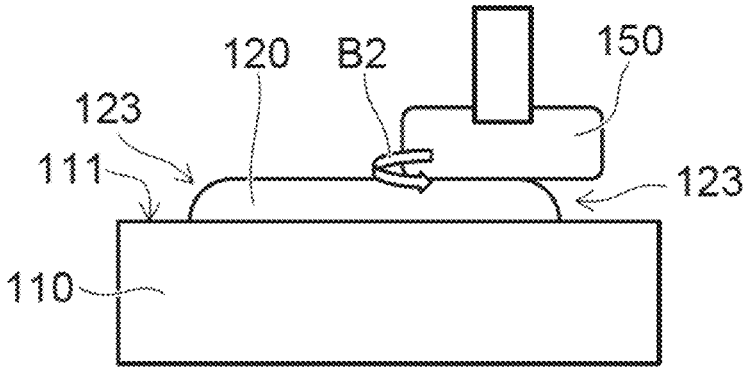

FIG. 12A and FIG. 12B are schematic sectional views describing the method for forming the film-like structural body in which the film thickness is changed stepwise in one step.

The film-like structural body 120 of the samples (1) to (3) shown in FIG. 9 and the sample (17) shown in FIG. 10 is formed by the formation method of this specific example.

As shown in FIG. 12A, a masking tape 130 is placed on the end part of the surface 111 of the base material 110. Subsequently, a film-like structural body 120 is formed generally entirely on the surface 111 of the base material 110 except the portion of the masking tape 130 by scanning the nozzle 140 or the base material 110 as indicated by arrow B1 shown in FIG. 12A.

Subsequently, as shown in FIG. 12B, the masking tape 130 is removed. Then, what is called buff polishing is performed on the end part of the film-like structural body 120. More specifically, a slope part 123 is formed in the end part of the film-like structural body 120 by e.g. rotating a polishing wheel 150 with a prescribed polishing agent as indicated by arrow B2 shown in FIG. 12B.

The formation method of this specific example can control the shape of the film-like structural body 120 (e.g., the shape of the slope part 126) with a desired accuracy, and form a stabler slope part 123.

Figure 13A:
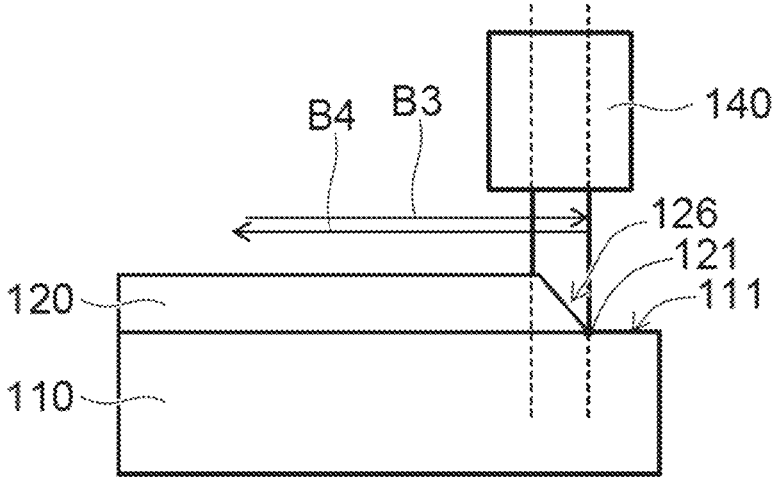
FIG. 13A and FIG. 13B are schematic sectional views describing the method for forming the film-like structural body in which the film thickness of the film-like structural body is changed stepwise by controlling the scanning of the nozzle or the base material.
Figure 13B:
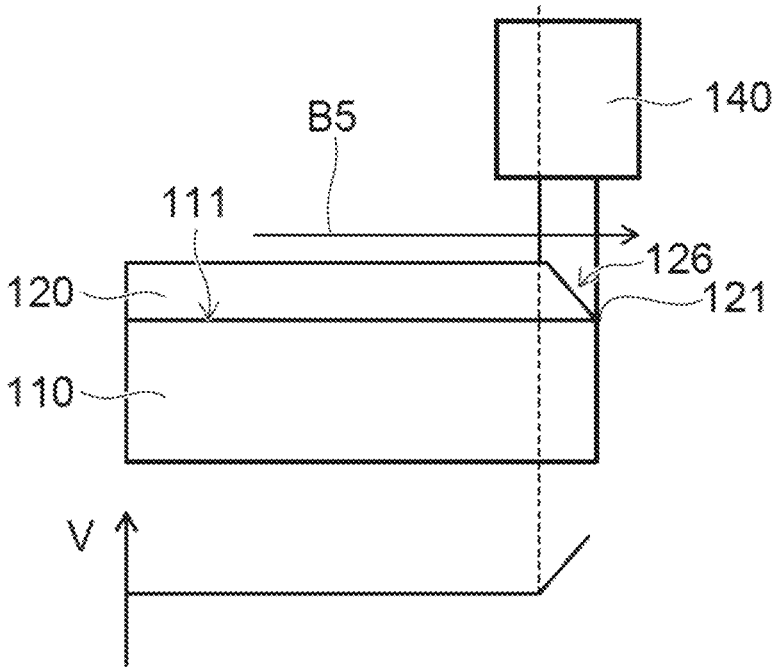

FIG. 13A and FIG. 13B are schematic sectional views describing the method for forming the film-like structural body in which the film thickness of the film-like structural body is changed stepwise by controlling the scanning of the nozzle or the base material.

FIG. 13A is a schematic sectional view describing the method for forming the film-like structural body in which the scanning direction is inverted. FIG. 13B is a schematic sectional view describing the method for forming the film-like structural body in which the scanning velocity is changed.

The film-like structural body 120 of the sample (7) and the sample (14) shown in FIG. 9 is formed by the formation method of the specific example shown in FIG. 13A.

The method for forming the film-like structural body 120 shown in FIG. 13A uses a nozzle 140 having a width generally equal to the width of the desired slope part 126 (e.g., component D1 shown in FIG. 3). The slope part 126 can be formed by inverting the scanning direction of the nozzle 140 at the desired end part 121 as indicated by arrows B3 and B4 shown in FIG. 13A.

For instance, the nozzle 140 having a width of 10 mm is used to squirt an aerosol from the jetting port of the nozzle 140 toward the surface 111 of the base material 110 in a feed amount (step amount) of 1 mm each. Then, the film thickness of the film-like structural body 120 is changed stepwise in 10 steps in a width of 10 mm. That is, 10 steps are formed in a width of 10 mm. In other words, a slope part 126 having a width of the nozzle 140 is formed in the end part of the film-like structural body 120 where squirting is not repeated.

Thus, the width of the slope part 126 can be controlled by the width of the nozzle 140.

The method for forming the film-like structural body 120 shown in FIG. 13B partially changes the scanning velocity V of the nozzle 140 or the base material 110. Specifically, as shown in FIG. 13B, the scanning velocity V of the nozzle 140 or the base material 110 is accelerated when the nozzle 140 approaches the desired end part 121. Accordingly, a slope part 126 can be formed.

Thus, by previously configuring a scanning program, the slope part 126 can be formed without interrupting the process for forming the film-like structural body 120.

Figure 14:
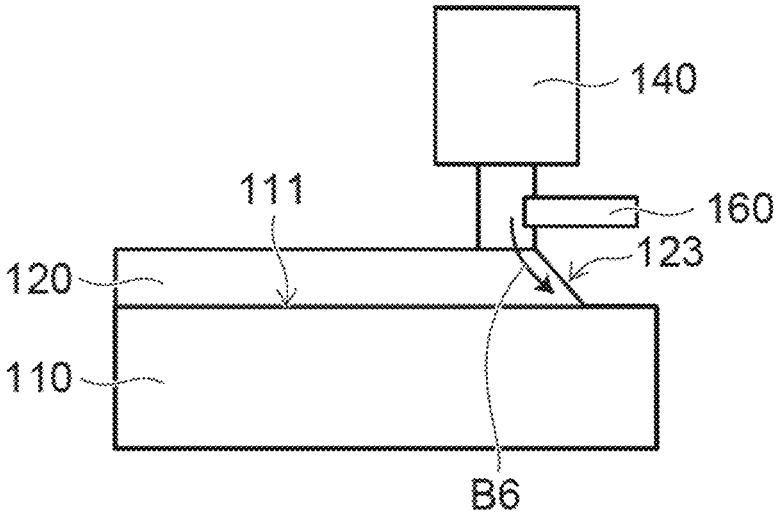
FIG. 14 is a schematic sectional view describing the method for forming the film-like structural body in which the film thickness of the film-like structural body is changed generally continuously.

FIG. 14 is a schematic sectional view describing the method for forming the film-like structural body in which the film thickness of the film-like structural body is changed generally continuously.

The film-like structural body 120 of the sample (10) shown in FIG. 9 is formed by the formation method of this specific example.

The method for forming the film-like structural body 120 shown in FIG. 14 provides a mask 160 between the nozzle 140 and the base material 110. An aerosol is squirted from the jetting port of the nozzle 140 toward the surface 111 of the base material 110, and passes near the end part of the mask 160. Then, the aerosol spreads to the lower side of the mask 160 as indicated by arrow B6 shown in FIG. 14. Accordingly, a slope part 123 having a generally continuously changing film thickness can be formed.

Thus, the slope part 123 having a generally continuously changing film thickness can be formed by a simpler mechanism such as providing a mask 160.

Furthermore, a slope part having a generally continuously changing film thickness can be formed by a simple mechanism such as adjusting the spraying angle of fine particles or smoothly polishing the film outer peripheral part.

Next, the shape of the slope part measured by the inventor is described with reference to the drawings.

Figure 15A:
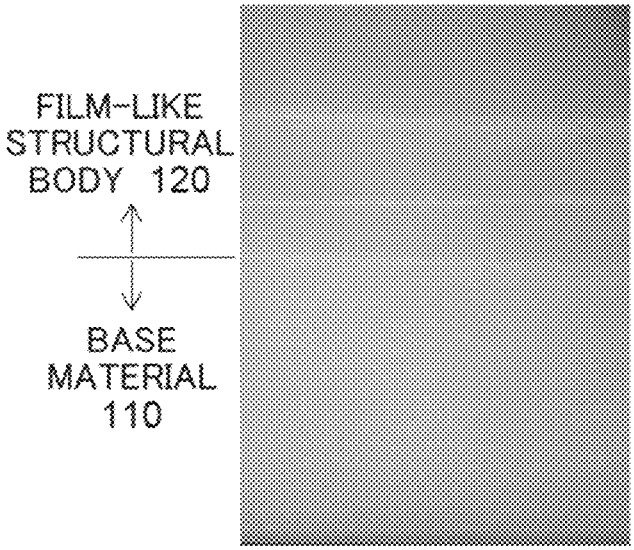
FIG. 15A and FIG. 15B are a photograph and a cross-sectional profile illustrating an example of the slope part of the sample (5) shown in FIG. 9.
Figure 15B:
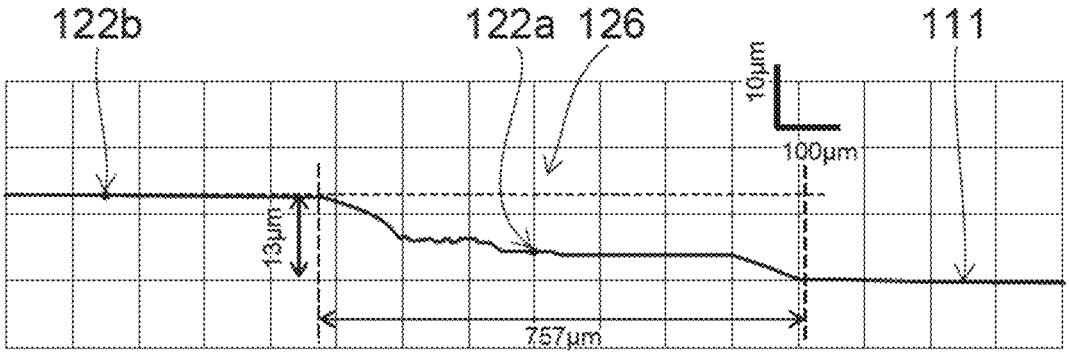

FIG. 15A and FIG. 15B are a photograph and a cross-sectional profile illustrating an example of the slope part of the sample (5) shown in FIG. 9.

The film-like structural body 120 of the sample (5) shown in FIG. 9 is formed by the formation method described above with reference to FIGS. 11A and 11B.

As shown in FIG. 9 and FIG. 15B, the magnification in the slope part 126 of the sample (5) is 757 μm/13 μm≈58 times. In this case, as shown in FIG. 15A, peeling 201 and collapse 203 of the film-like structural body 120 or collapse 205 of the base material 110 has not occurred.

Figure 16A:
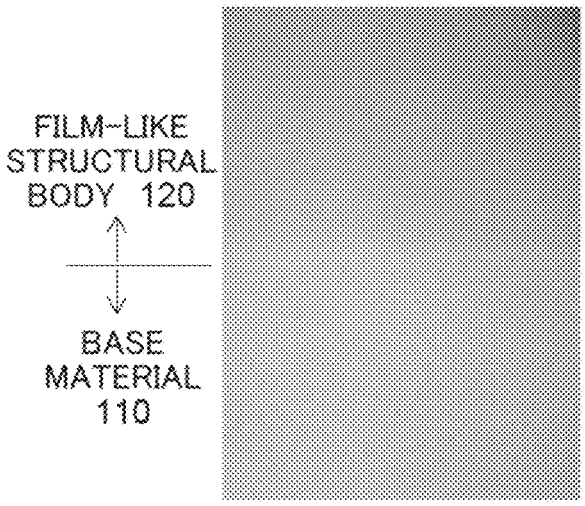
FIG. 16A and FIG. 16B are a photograph and a cross-sectional profile illustrating an example of the slope part of the sample (17) shown in FIG. 10.
Figure 16B:
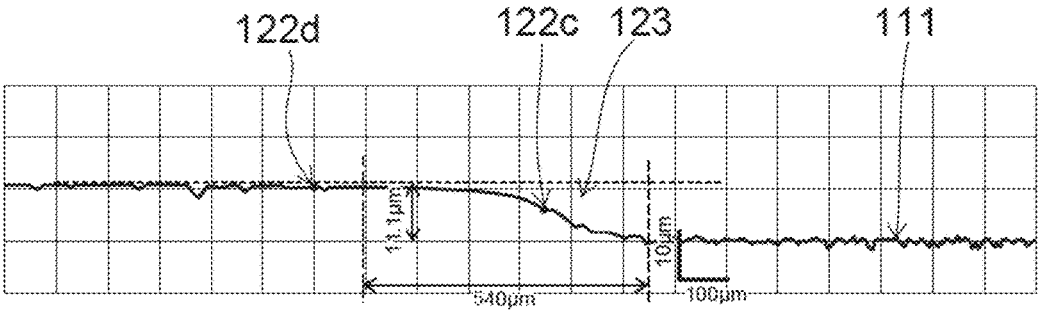

FIG. 16A and FIG. 16B are a photograph and a cross-sectional profile illustrating an example of the slope part of the sample (17) shown in FIG. 10.

The film-like structural body 120 of the sample (17) shown in FIG. 10 is formed by the formation method described above with reference to FIG. 12A and FIG. 12B.

As shown in FIG. 10 and FIG. 16B, the magnification in the slope part 123 of the sample (17) is 540 μm/11.1 μm≈49 times. In this case, as shown in FIG. 16A, peeling 201 and collapse 203 of the film-like structural body 120 or collapse 205 of the base material 110 has not occurred.

The inventor used the sample (5) shown in FIG. 9 and the sample (17) shown in FIG. 10 to measure the Vickers hardness at an arbitrary point of the slope part 123, 126 and the Vickers hardness at an arbitrary point of the portion of the average film thickness t, three times each. The result is as follows. Here, the inventor has converted the Vickers hardness (HV) to the value in gigapascals (GPa).

The Vickers hardness at a first measurement point 122*a* shown in FIG. 15B is 8.06 GPa (measurement for the first time), 8.04 GPa (measurement for the second time), and 7.80 GPa (measurement for the third time). The Vickers hardness at a second measurement point 122*b* shown in FIG.

15B is 7.80 GPa (measurement for the first time), 7.79 GPa (measurement for the second time), and 8.04 GPa (measurement for the third time).

The Vickers hardness at a third measurement point 122*c* shown in FIG. 16B is 7.82 GPa (measurement for the first time), 8.03 GPa (measurement for the second time), and 8.03 GPa (measurement for the third time). The Vickers hardness at a fourth measurement point 122*d* shown in FIG. 16B is 8.02 GPa (measurement for the first time), 8.00 GPa (measurement for the second time), and 7.83 GPa (measurement for the third time).

Thus, the average value of all the Vickers hardnesses at the first to fourth measurement points 122*a*, 122*b*, 122*c*, 122*d* is 7.931 GPa. The standard deviation (a) of all the Vickers hardnesses at the first to fourth measurement points 122*a*, 122*b*, 122*c*, 122*d* is 0.129 GPa. The coefficient of variation of all the Vickers hardnesses at the first to fourth measurement points 122*a*, 122*b*, 122*c*, 122*d* is 1.6%. According to the knowledge obtained by the inventor, the structural body can be determined as a compact structural body if the following condition is satisfied as an index of compactness.

$$0.7<(\text{average}\pm 6\sigma)/\text{average}<1.3$$

Thus, in this description, it can be determined that a compact structural body is formed in the slope part 123 in the case where the Vickers hardness in the slope part 123 is larger than 70% and smaller than 130% of the Vickers hardness in the portion of the average film thickness t.

Figure 17:
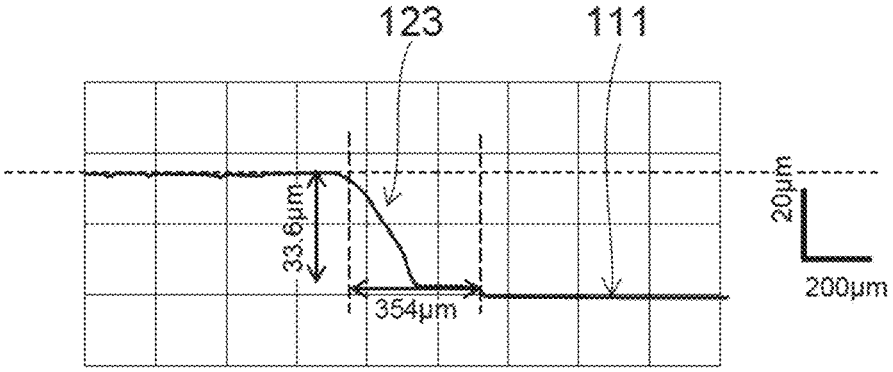
FIG. 17 is a cross-sectional profile illustrating an example of the slope part of the sample (3) shown in FIG. 9.

FIG. 17 is a cross-sectional profile illustrating an example of the slope part of the sample (3) shown in FIG. 9.

The film-like structural body 120 of the sample (3) shown in FIG. 9 is formed by the formation method described above with reference to FIG. 12A and FIG. 12B.

As shown in FIG. 9 and FIG. 17, the magnification in the slope part of the sample (3) is 354 μm/33.6 μm≈10 times. In this case, peeling 201 and collapse 203 of the film-like structural body 120 or collapse 205 of the base material 110 has not occurred.

Figure 18A:
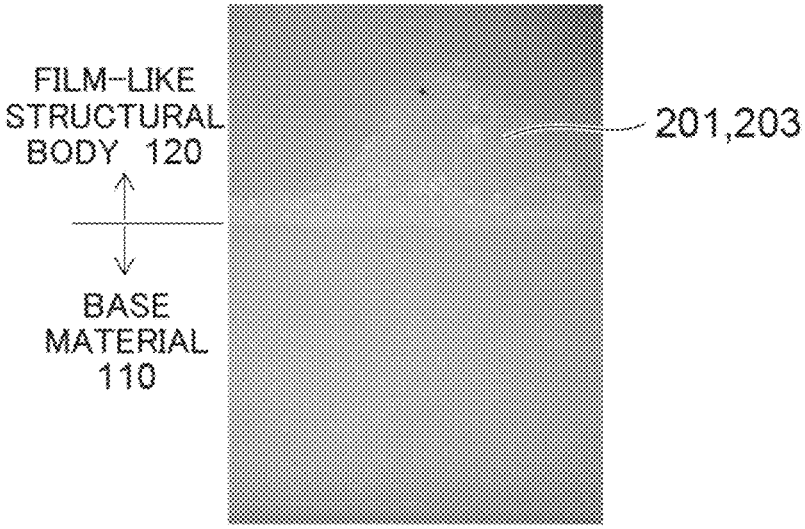
FIG. 18A and FIG. 18B are a photograph and a cross-sectional profile illustrating an example of the slope part of the sample (1) shown in FIG. 9.
Figure 18B:
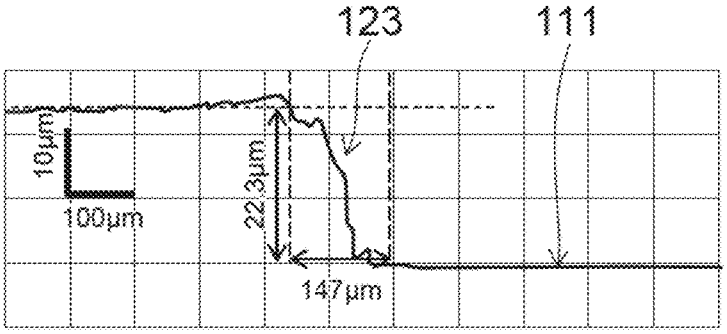

FIG. 18A and FIG. 18B are a photograph and a cross-sectional profile illustrating an example of the slope part of the sample (1) shown in FIG. 9.

The film-like structural body 120 of the sample (1) shown in FIG. 9 is formed by the formation method described above with reference to FIG. 12A and FIG. 12B.

As shown in FIG. 9 and FIG. 18B, the magnification in the slope part of the sample (1) is 142 μm/22.3 μm≈7 times, which is less than 10 times. In this case, as shown in FIG. 18A, peeling 201 or collapse 203 of the film-like structural body 120 has occurred.

Figures 19, 20:
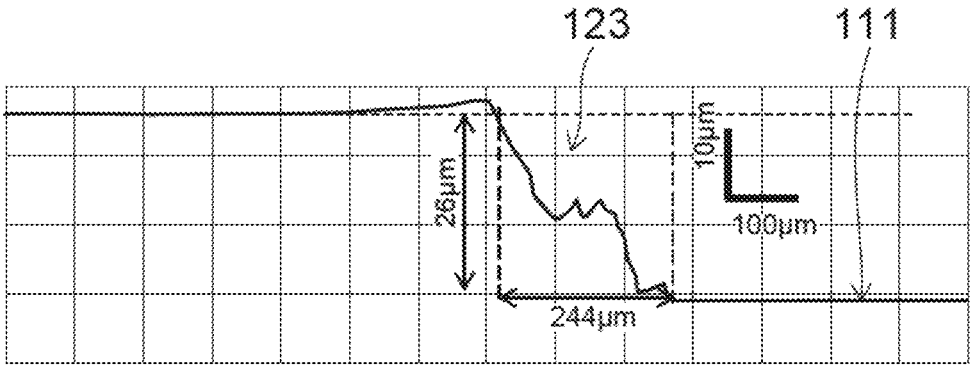
FIG. 19 is a cross-sectional profile illustrating an example of the slope part of the sample (2) shown in FIG. 9.
FIG. 20 is a table illustrating an example of the result of simulating the stress applied to the end part of the film-like structural body.

FIG. 19 is a cross-sectional profile illustrating an example of the slope part of the sample (2) shown in FIG. 9.

The film-like structural body 120 of the sample (3) shown in FIG. 9 is formed by the formation method described above with reference to FIG. 12A and FIG. 12B.

As shown in FIG. 9 and FIG. 19, the magnification in the slope part of the sample (2) is 244 μm/26 μm≈9 times, which is less than 10 times. In this case, peeling 201 of the film-like structural body 120 has occurred.

Next, an example of the result of simulation performed by the inventor is described with reference to the drawings.

FIG. 20 is a table illustrating an example of the result of simulating the stress applied to the end part of the film-like structural body.

Figure 21A:
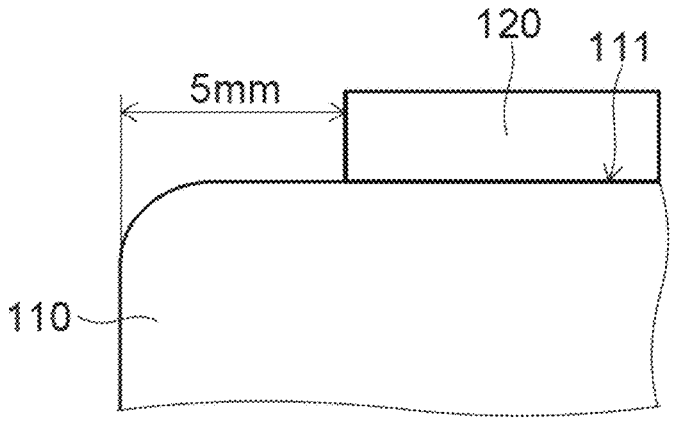
FIG. 21A to FIG. 21C are schematic sectional views illustrating models of the slope part of the film-like structural body.
Figure 21B:
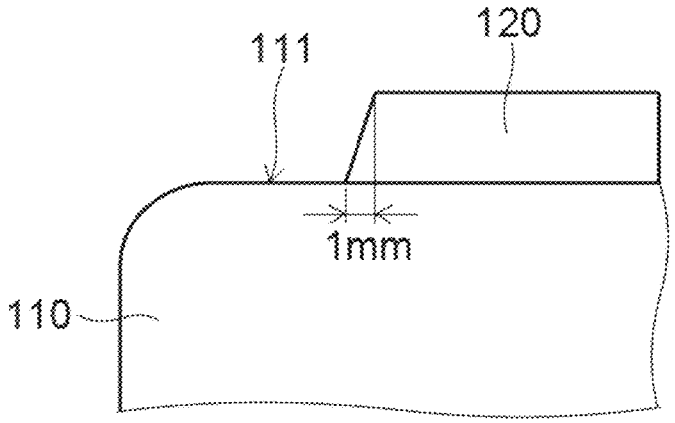
Figure 21C:
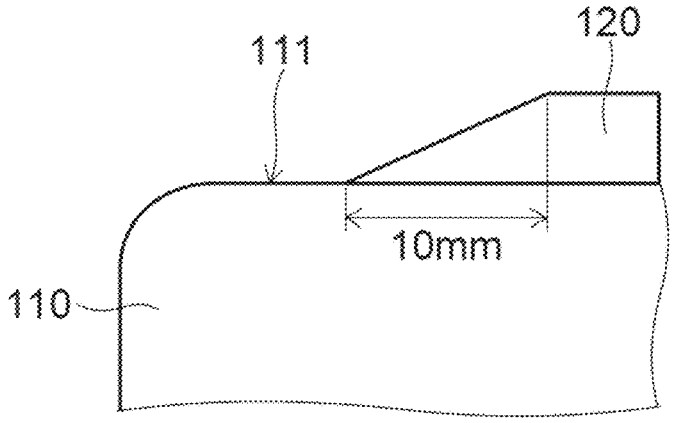

FIG. 21A to FIG. 21C are schematic sectional views illustrating models of the slope part of the film-like structural body.

The inventor calculated the stress in the case where a film-like structural body 120 including yttrium oxide is formed on the base material 110 of aluminum oxide. As shown in FIG. 21A to FIG. 21C, the film thickness of the film-like structural body 120 was set to 12 μm. The calculation (simulation) of stress was performed using NX I-DEAS Ver. 5 available from Siemens. Analysis of the stress was performed using the following equation.

[Equation 1]

$$\sigma = \frac{E}{1-\nu} * \frac{h^2}{R \cdot 6t} \tag{1}$$

Here, the symbol "σ" in Equation (1) represents stress. The symbol "E" in Equation (1) represents Young's modulus of the base material. The symbol "ν" in Equation (1) represents Poisson's ratio of the base material 110. The symbol "h" in Equation (1) represents the thickness of the base material 110. The symbol "t" in Equation (1) represents the film thickness of the film-like structural body 120. The symbol "R" in Equation (1) represents the bending radius produced by the deformation of the base material 110.

The model (1) shown in FIG. 20 was configured to be formed by the formation method described above with reference to FIGS. 12A and 12B.

The model (2) shown in FIG. 20 was configured to be formed by the formation method described above with reference to FIG. 14.

The model (3) shown in FIG. 20 was configured to be formed by the formation method described above with reference to FIG. 13B.

An example of the result of calculating the maximum stress applied to the base material 110 is as shown in FIG. 20. That is, it has turned out that the stress applied to the base material 110 decreases with the increase of magnification. In other words, it has turned out that the stress applied to the base material 110 can be relaxed by forming a slope part 123, 126 in the end part of the film-like structural body 120.

Next, a specific example of the film formation apparatus for forming the film-like structural body 120 of this embodiment is described with reference to the drawings.

Figure 22:
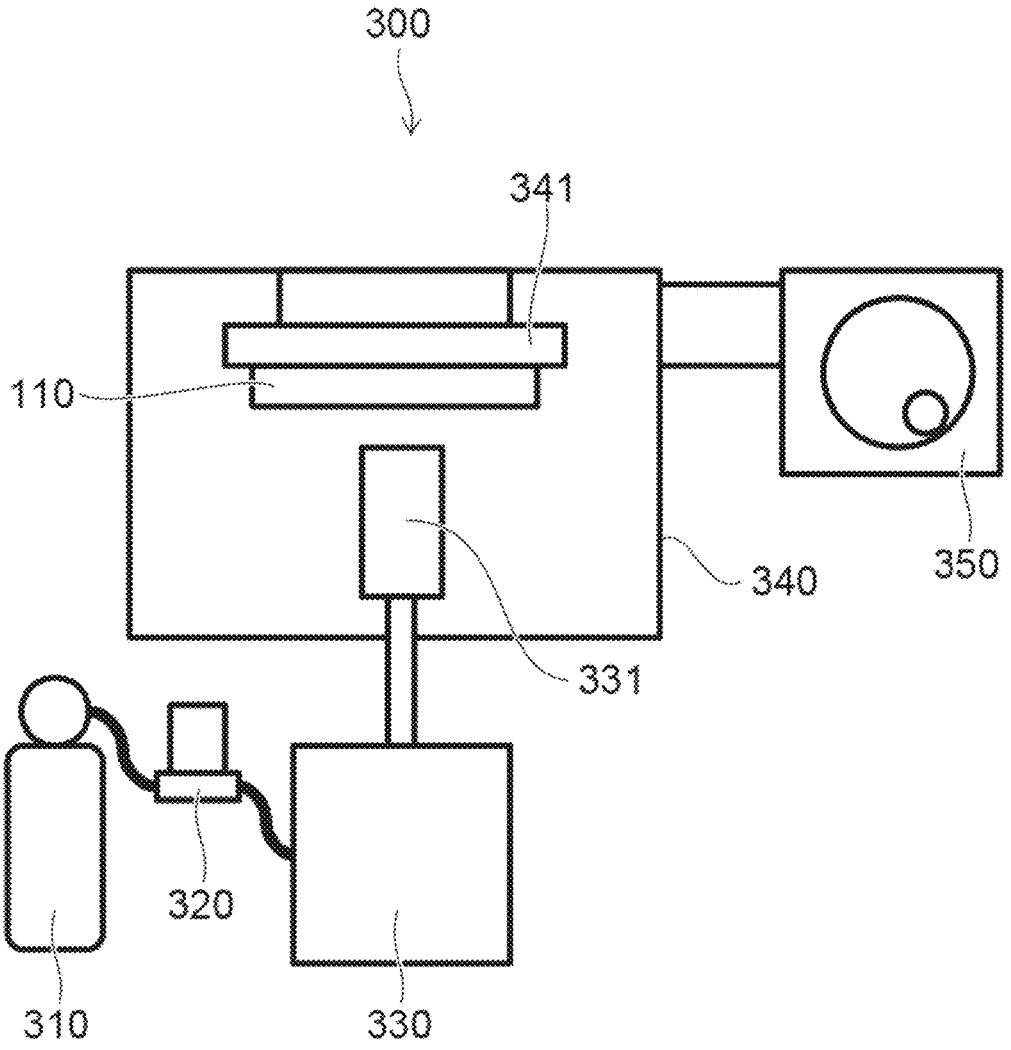
FIG. 22 is a schematic configuration view illustrating a specific example of the film formation apparatus for forming the film-like structural body of this embodiment.

FIG. 22 is a schematic configuration view illustrating a specific example of the film formation apparatus for forming the film-like structural body of this embodiment.

The film formation apparatus 300 of this specific example includes a gas cylinder 310, a gas supply mechanism 320, an aerosol generator 330, a film formation chamber 340, and a vacuum pump 350. A nozzle 331 is placed in one end part of the aerosol generator 330. The nozzle 331 is placed inside the film formation chamber 340. A base material 110 is placed at the position facing the jetting port of the nozzle 331. The base material 110 is supported by a stage 341 placed inside the film formation chamber 340.

The carrier gas used for aerosol deposition is supplied from the gas cylinder 310 with the flow rate regulated by the gas supply mechanism 320, and is introduced to the aerosol generator 330. The aerosol generator 330 is charged with raw material fine particles. An aerosol is obtained by mixing of the carrier gas introduced from the gas supply mechanism 320 and the raw material fine particles inside the aerosol generator 330. The aerosol generated inside the aerosol generator 330 is transported out to the nozzle 331 by pressure difference, and squirted from the jetting port of the nozzle 331 toward the base material 110. The base material 110 is supported by the stage 341. For instance, the stage 341 is swung in two dimensions along XY-axes. Thus, the aerosol is squirted on a desired area to deposit the fine particles. Accordingly, a film-like structural body 120 can be formed. Under the film formation environment, the air inside the film formation chamber 340 is evacuated by the vacuum pump 350.

In the aerosol, a preferable state is one in which fine particles are dispersed as primary particles. However, the state in which a plurality of primary particles are aggregated and dispersed in the gas as aggregate particles is also encompassed within the scope of the aerosol referred to herein.

The transport gas only needs to be able to disperse fine particles to form an aerosol. For instance, the transport gas may be dry air, hydrogen gas, nitrogen gas, oxygen gas, argon gas, helium gas or other inert gases, methane gas, ethane gas, ethylene gas, acetylene gas or other organic gases, or corrosive gases such as fluorine gas. Furthermore, the transport gas may be a mixed gas of these gases as necessary.

The fine particle can be a fine particle having a particle diameter of approximately 0.1-5 μm. The raw material of the fine particle can be e.g. oxides such as aluminum oxide, zirconium oxide, yttrium oxide, titanium oxide, silicon oxide, barium titanate, lead zirconate titanate, gadolinium oxide, and ytterbium oxide, or nitrides, borides, carbides, fluorides or other brittle materials. Furthermore, the raw material of the fine particle can be e.g. a composite material composed primarily of a brittle material and combined with metal or resin.

The material of the base material 110 can be one of metal, glass, ceramic, and resin, or a composite material thereof. The shape of the surface 111 of the base material 110 is not limited to a flat surface, but may be a curved surface, such as the inner peripheral side surface of a ring shape, and the outer periphery of a cylinder.

The embodiments of the invention have been described above. However, the invention is not limited to the above description. Those skilled in the art can appropriately modify the above embodiments, and such modifications are also encompassed within the scope of the invention as long as they include the features of the invention. For instance, the shape, dimension, material, arrangement and the like of various components in the base material 110, the film-like structural body 120 and the like, and the installation configuration and the like of the slope parts 123, 126 are not limited to those illustrated, but can be modified appropriately.

Furthermore, various components in the above embodiments can be combined with each other as long as technically feasible. Such combinations are also encompassed within the scope of the invention as long as they include the features of the invention.

What is claimed is:

1. A composite structural body comprising:

a base material; and a film-like structural body formed on a surface of the base material by causing an aerosol to impinge on the base material, the aerosol including fine particles dispersed in a gas, said fine particles including at least one of aluminum fluoride, zirconium fluoride, yttrium fluoride, titanium fluoride, silicon fluoride, gadolinium fluoride and ytterbium fluoride, a distance between an end part of the film-like structural body and an outermost part closest to the end part of a portion of the film-like structural body having a film thickness equal to an average film thickness of the film-like structural body as viewed perpendicular to the surface being 10 times or more of the average film thickness.

2. A composite structural body according to claim 1, wherein the base material includes at least one of metal, glass, ceramic, and resin, or a composite material thereof.

* * * * *